US005464261A

United States Patent [19]

Alkhoury

[11] Patent Number: 5,464,261

[45] Date of Patent: Nov. 7, 1995

[54] LOCK FOR SLIDING DOORS AND WINDOWS

[76] Inventor: Boulos Alkhoury, 77 Carleton Place, Brampton, Ontario, Canada, L6T 3Z4

[21] Appl. No.: 246,449

[22] Filed: May 20, 1994

[51] Int. Cl.[6] ..... E05C 5/04

[52] U.S. Cl. ..... 292/251; 292/DIG. 47

[58] Field of Search ..... 292/147, 149, 292/251, 135, DIG. 20, DIG. 46, DIG. 47; 49/449

[56] References Cited

U.S. PATENT DOCUMENTS

| | | | |
|---|---|---|---|
| 1,320,461 | 11/1919 | Erickson | 292/335 |
| 1,907,625 | 5/1933 | Vogt | 292/DIG. 46 |
| 4,045,982 | 9/1977 | Gorton et al. | 292/DIG. 46 |
| 4,138,150 | 2/1979 | Bills | 292/DIG. 20 |
| 4,699,406 | 10/1987 | Swanson, Jr. | 292/DIG. 47 |
| 4,829,887 | 5/1989 | Holschbach | 49/449 |
| 5,209,018 | 5/1993 | Heinrich | 49/449 |
| 5,356,185 | 10/1994 | Cameron | 292/149 |

*Primary Examiner*—Peter M. Cuomo
*Assistant Examiner*—Monica E. Millner

[57] ABSTRACT

A locking mechanism for securing sliding glass panel units including an elongate threaded fastener having a threaded forward end section and a rear end section. This fastener has a knob or handle for rotating the fastener about its central axis, this knob being mounted on the rear end section. A mounting plate is used to rotatably mount the fastener in a support frame so that the fastener extends through a hole in the plate and the support frame. An anchor with a threaded aperture is fixedly mounted in the sliding glass panel unit and this aperture is capable of threadedly receiving the forward end section of the fastener. Preferably a spring is arranged on the fastener between the mounting plate and the knob or handle, this spring acting to bias the fastener away from the anchor. The mechanism can be used with either sliding glass windows or sliding glass doors.

23 Claims, 6 Drawing Sheets

LOCK FOR SLIDING DOORS AND WINDOWS

BACKGROUND OF THE INVENTION

This invention relates to devices for securing or locking a sliding glass panel unit such as a sliding glass door or sliding glass window.

A variety of fastening or locking devices are known for securing sliding glass panel units in place. These devices are generally mounted in the metal, wooden or vinyl frame that extends about the perimeter of a glass window unit or a glass door unit. Some of these locking or fastening devices secure the sliding glass units to adjoining door or window frames. In other cases, the mechanism can be used to lock together or to secure together two sliding glass panel units which, at least in their unlocked state, are capable of sliding relative to each other and relative to the adjacent frame in which they are mounted.

In one common form of locking mechanism that can be used to secure together two adjacent sliding glass panels there is a mounting plate or bracket on which is pivotably mounted a handle affixed to a short shaft. On the inner end of the shaft there is mounted a locking member having a substantially semi-circular periphery with a rib extending about this periphery on one side. This locking member is capable of engaging a suitable anchor member that is mounted on the frame of an adjacent glass panel unit, typically an exterior unit. By pivoting the handle one is able to lock the two glass panel units together and prevent any sliding movement.

Despite the widespread use of the aforementioned locking devices for sliding window units, problems with these locking devices do exist. For example, they do not provide much in the way of security to the users as they can be fairly easily broken and sometimes they can be forced to release or unlock from the outside of the window. One reason for this difficulty is that the anchor mechanism for the lock is often mounted on a portion of the window frame that can be readily dislodged, thereby rendering the lock useless. Another difficulty with these locking devices is that, particularly as the window units become worn, they can permit considerable air leakage or draughts between the adjacent sliding glass panel members. To overcome this problem it may be necessary to replace or install weatherproofing strips along the window frame.

It is an object of the present invention to provide a simple and inexpensive locking mechanism for securing a sliding glass panel unit.

It is a further object of the invention to provide a locking mechanism that forms a very secure and reliable connection between the sliding glass panel unit to be secured and the adjoining frame to which it is connected.

With the locking mechanism disclosed herein, it is possible to apply a pulling force to the glass panel unit so that it is drawn against the adjoining support frame. In this way it is possible to eliminate undesirable air gaps between the glass panel unit and the adjoining frame.

SUMMARY OF THE INVENTION

According to one aspect of the invention, a locking mechanism for securing a sliding glass panel unit comprises an elongate threaded fastener having a threaded forward end section and a rear end section. This fastener includes means for rotating same about its central axis mounted on the rear end section. The mechanism further includes means for rotatably mounting the fastener in a support frame so that the fastener extends through a hole in the support frame and an anchor device with a threaded aperture adapted for mounting fixedly in the sliding glass panel unit. The aperture is capable of threadedly receiving the forward end section of the fastener.

Preferably a spring is arranged on the fastener between the mounting means and the rotating means, this spring acting to bias the fastener away from the anchor device when the latter is mounted in the glass panel unit.

According to another aspect of the invention, a system of sliding glazing units for a building or other large structure comprises first and second glazing units adapted for sliding movement relative to one another and an elongate fastener which is threaded along at least a forward end section thereof. This fastener includes means for rotating the fastener about its central axis located at a rear end thereof. There are also means for rotatably mounting the fastener in the first glazing unit so that the fastener extends through a hole in a frame that forms an edge portion of the glazing unit. An anchor device with a threaded aperture is fixedly mounted in the second glazing unit and this aperture is capable of threadedly receiving the forward end section of the fastener. The glazing units are prevented from sliding movement when the fastener is engaged with the anchor device.

In a preferred embodiment, the mounting means is a mounting plate having a hole through which the fastener extends and screws which connect this plate to the frame of the glazing unit.

According to a further aspect of the invention, a locking mechanism for securing a sliding glazing unit comprises an elongate fastener which is threaded along at least a forward end section thereof and which has a knob at a rear end thereof for rotating the fastener about its central axis. There is also a mounting plate for rotatably mounting the fastener in a support frame so that the fastener extends through holes in the plate and the support frame. Further fastener means connect the plate to a side of the support frame. An anchor device with a threaded aperture can be mounted in a frame of a glass panel unit and its aperture is capable of threadedly receiving the forward end section of the fastener.

Further features and advantages will become apparent from the following detailed description taken in conjunction with the accompanying drawings.

Figure 4:
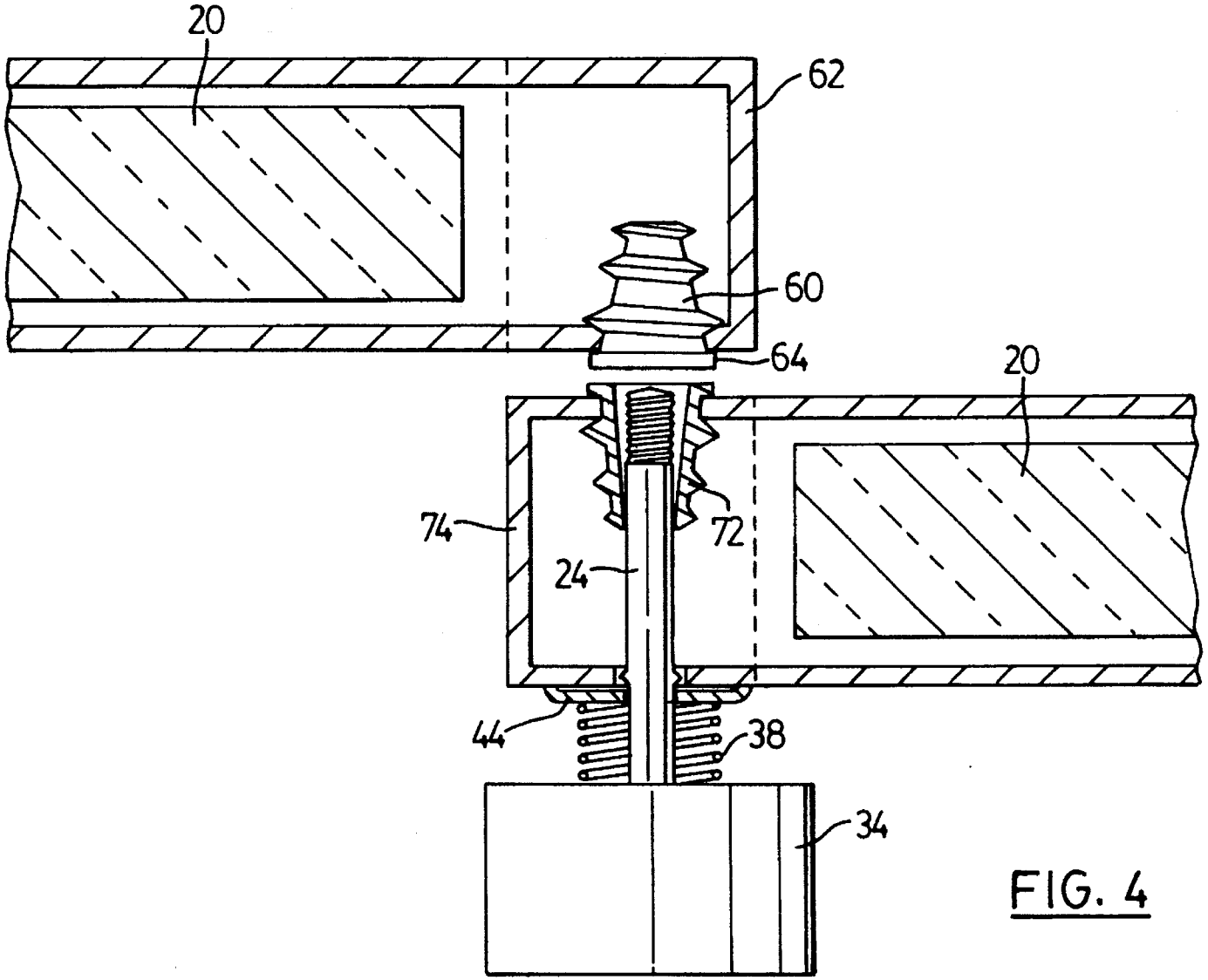
FIG. 4 is a detail view, taken in cross-section along the line IV—IV of FIG. 1 showing how the locking mechanism of FIG. 2 is mounted to secure together two sliding glass panel units.
Figure 5:
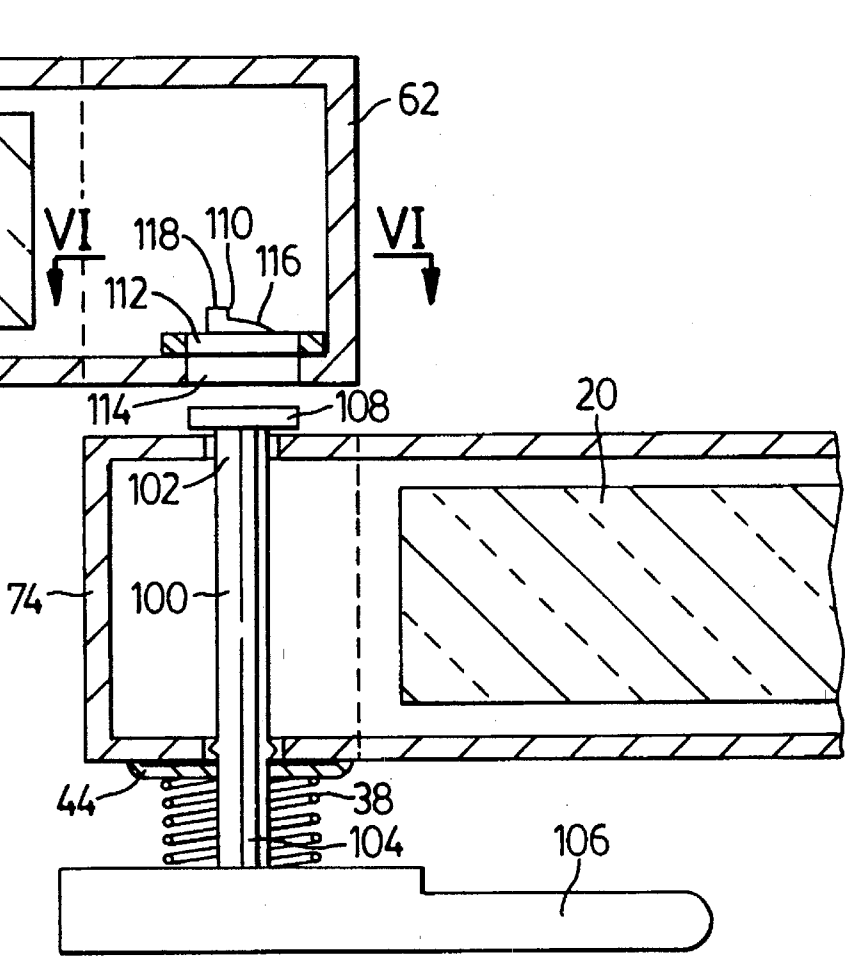
FIG. 5 is a detail view similar to FIG. 4 but showing another version of the invention with a handle to rotate the fastener.
Figure 7:
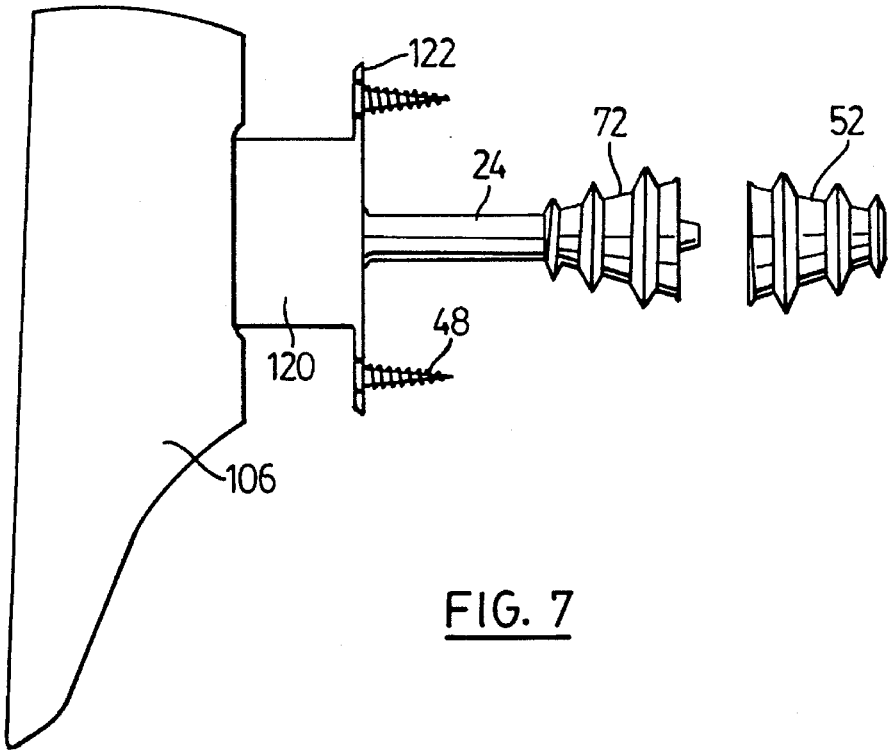
Figure 8:
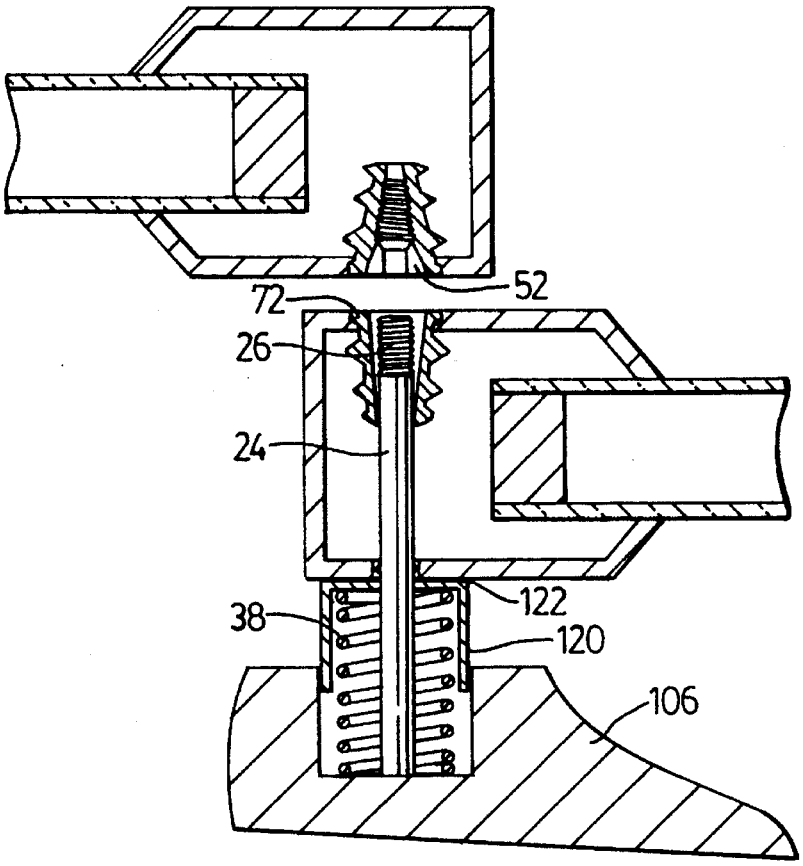
Figures 9, 10, 11, 12, 14:
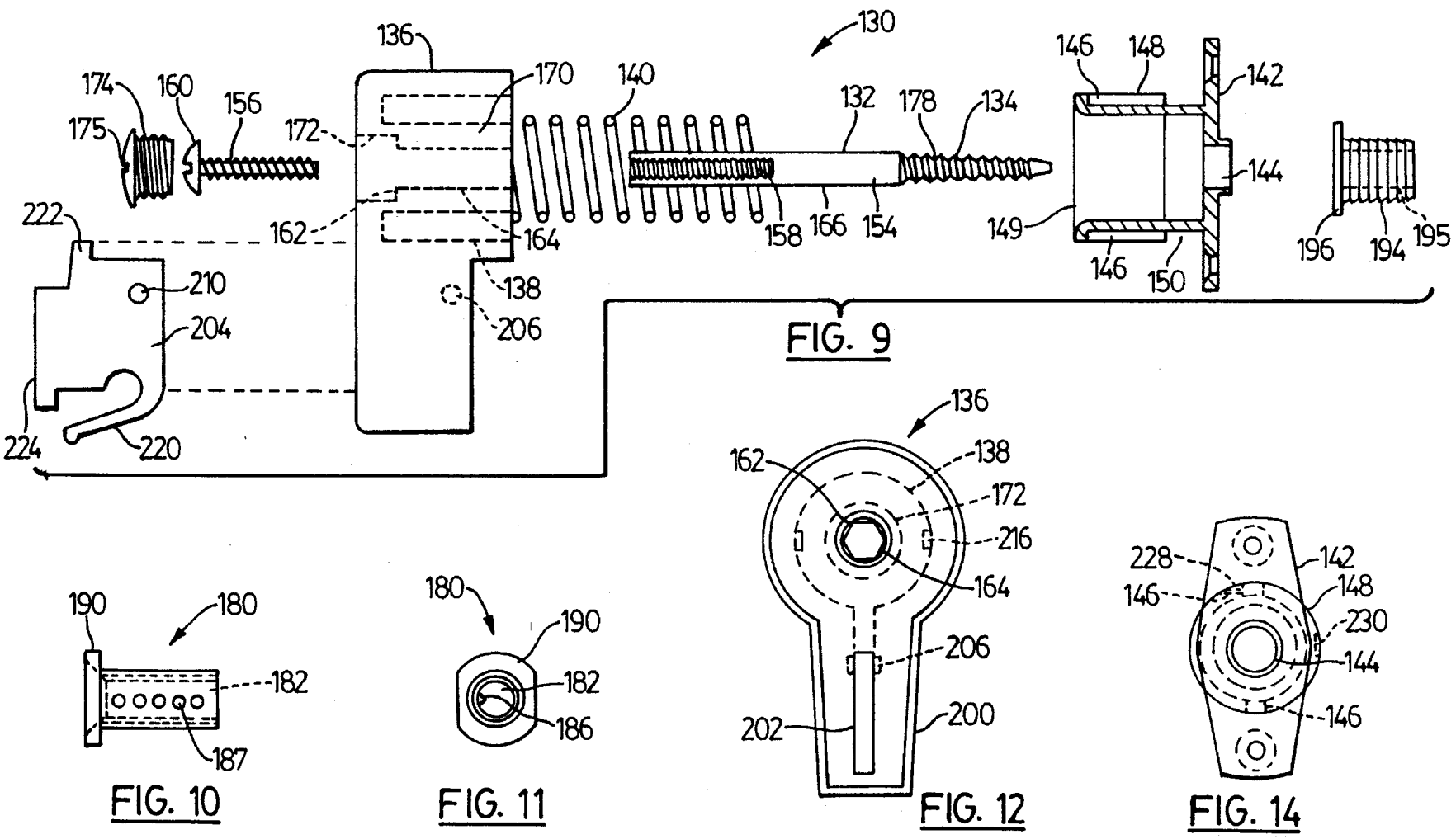
Figure 13:
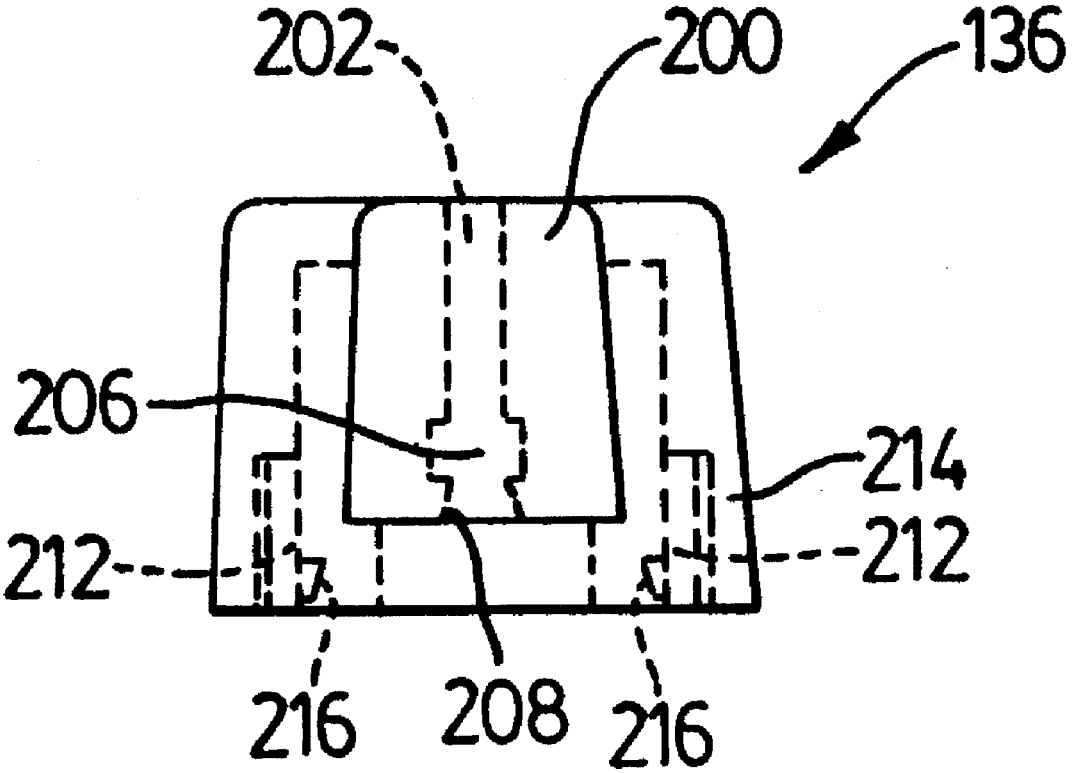

VI—VI of FIG. 5;

FIG. 7 is a side view of a preferred embodiment of a locking mechanism constructed in accordance with the invention; and FIG. 8 is a detail view, taken in cross-section, which view is similar to FIG. 4 but shows the locking mechanism of FIG. 7;

FIG. 9 is a side view, partly in cross-section, of another preferred embodiment of a locking mechanism constructed in accordance with the invention with the separate parts shown in axial alignment;

FIG. 10 is side view of a preferred form of anchor device for the locking mechanism of FIG. 9;

FIG. 11 is a right end view of the anchor device of FIG. 10;

FIG. 12 is an outer or left end view of the handle member used in the locking mechanism of FIG. 9;

FIG. 13 is a bottom view of the handle member shown in FIG. 12; and

FIG. 14 is an inside end view of the enclosure used in the mechanism of FIG. 9.

DETAILED DESCRIPTION OF PREFERRED EMBODIMENTS

Figure 1:
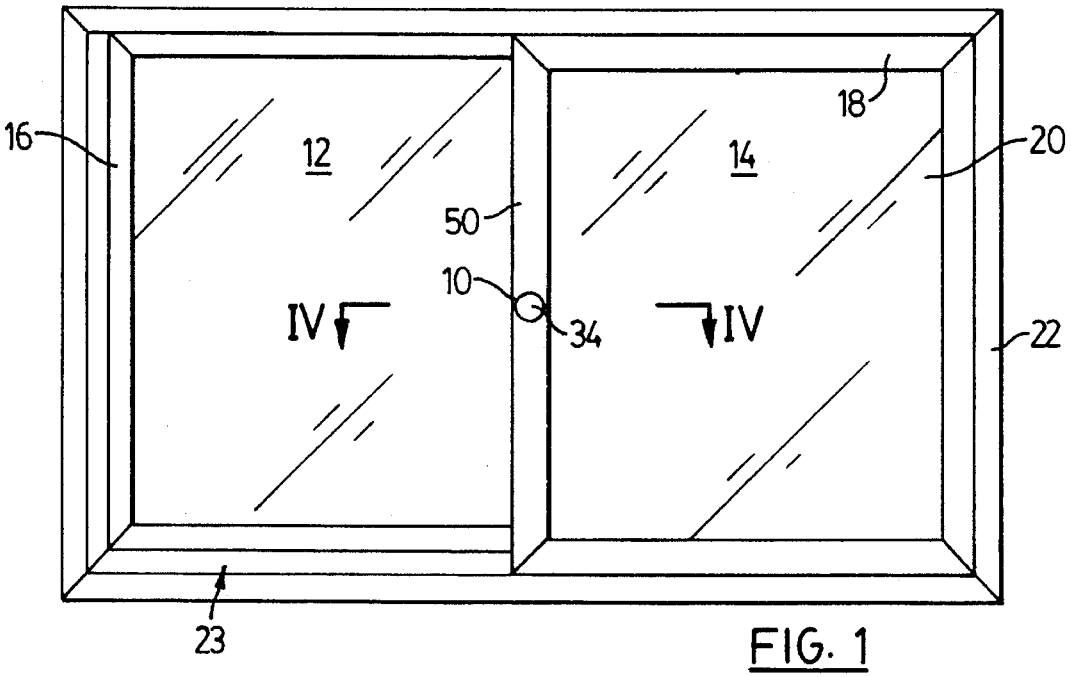
FIG. 1 is an inside elevation of a system of sliding glazing units intended for installation in a building or other large structure.

A locking mechanism 10 constructed in accordance with the invention can be used to secure a sliding glass panel unit either to another sliding glass panel unit or to a suitable adjoining rigid frame member. Shown in FIG. 1 is a system of sliding glazing units 12 and 14 designed for a building or other large structure. Although horizontally sliding units are illustrated, the invention can also be employed with vertically sliding units. These glazing units can, for example, be either sliding glass window units or sliding glass door units, the latter being generally much larger and extending to a height of six feet or more. Each of these glazing units has its own rectangular frame 16 and 18 extending about its periphery and a glass panel 20 is mounted in each frame. Although the glass panel could comprise a single glaze or glass sheet, it is common to construct the glass panel as a sealed unit comprising two or more glazes or sheets which are spaced apart, thus providing improved insulating characteristics. The glazing units are mounted for sliding movement in a window frame or door frame 22 which is also rectangular. The frame 22 supports an interior sash track 23. It will be understood that the glazing units 12 and 14 are per se of known construction and therefore a detailed description thereof is deemed unnecessary herein. It should be noted, however, that the frames 16 and 18 can be made of a variety of materials including a metal such as aluminum or aluminum alloy, a plastic such as polyvinylchloride (PVC), or wood. When these frame members are made from metal or plastic, they are generally made by an extrusion process and they have a hollow profile as shown in FIG. 4.

Figure 2:
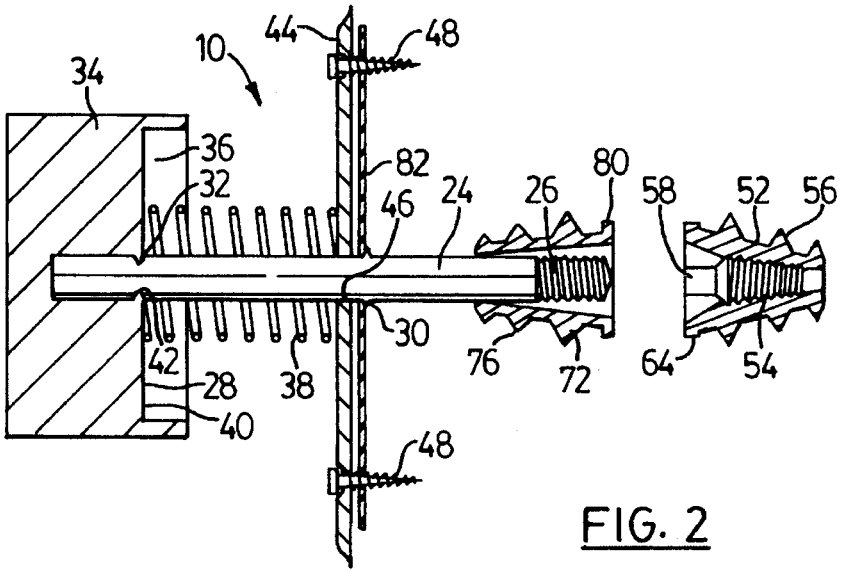
FIG. 2 is a side view, partly in cross-section, of a locking mechanism for securing a sliding glass panel unit, which mechanism is constructed in accordance with the invention.

Turning now to the construction of the locking mechanism 10 as illustrated in FIG. 2, the mechanism includes an elongate threaded fastener or bolt 24 having a threaded forward end section 26 and a rear end section 28. The fastener 24 has a stop or ridge 30 formed thereon for a purpose described hereinafter. The stop may comprise simply small bumps formed on opposite sides of the fastener about midway along its length or a circumferential ridge. Preferably the fastener 24 is formed with a V-groove 32 a short distance from its rear end. This V-groove is used to attach a means for rotating the fastener about its central axis. The preferred illustrated rotating means is a knob 34 which permits the fastener to be rotated manually. This knob can be formed with a circular recess 36 in its inside surface, which recess helps accommodate an end of a coil spring 38. The knob 34 is formed with a central hole 40 into which the rear end section of the fastener is inserted. In the preferred illustrated embodiment, there are small tabs or a small flange 42 formed at the edge of the hole 40 and which snap into the aforementioned V-groove 32 to hold the fastener in place. The knob can be made of plastic, metal, or even wood and it can have a smooth circumferential surface or this surface can be knurled. Typically, the fastener or bolt 24 can range in length from 2¼ inches to 3¾ inches, the selected length depending upon the thickness of the frame or profile through which the fastener must extend. It will be understood that a handle could be employed in place of the illustrated knob.

The locking mechanism 10 further includes means for rotatably mounting the fastener 24 in a support frame so that the fastener extends through a hole in the support frame. In the illustrated preferred embodiment, this mounting means comprises a flat mounting plate 44 having a central hole 46 through which the fastener extends and screws 48 for connecting the plate to the support frame. In the system shown in FIG. 1, the plate 44 would be used to connect the locking mechanism to the inside surface of vertically extending frame member or stile 50. In one embodiment, the plate 44 has a length of three inches and a width of three quarters inch. The plate can be made of a strong metal such as steel or a strong plastic such as PVC. Preferably at least two screws 48 are used and these extend through holes at opposite ends of the plate. The plate 44 rests against the stop 30 and is positioned thereby. Of course in vertically sliding panel units the plate 44 is attached to a horizontal frame member.

The aforementioned spring 38 has one end resting against the mounting plate 44 and its opposite end pressing against the knob 34. The spring acts to bias the fastener 24 away from an anchor device 52 when the latter is mounted in the glass panel unit such as the unit 12 of FIG. 1.

One form of anchor device is that shown in FIG. 2. This device is a sleeve member having internal threads at 54 and larger, external threads means at 56. This anchor can have an enlarged opening 58 at the end facing the threaded fastener 24 in order to make it easier to introduce the threaded forward end 26 into the anchor. The thread means 56 on the outside surface can be of the intermittent type comprising a series of pointed projections 60 as illustrated in FIG. 4. These projections 60 help to hold the anchor in the hollow frame member or stile such as that shown at 62 in FIG. 4. Furthermore, the anchor device 52 is formed with a radially outwardly extending circumferential flange 64 at the end with the wide opening 58. This flange rests against the outer surface of the frame member 62 as shown in FIG. 4 and helps to correctly position the anchor device.

Figure 3:
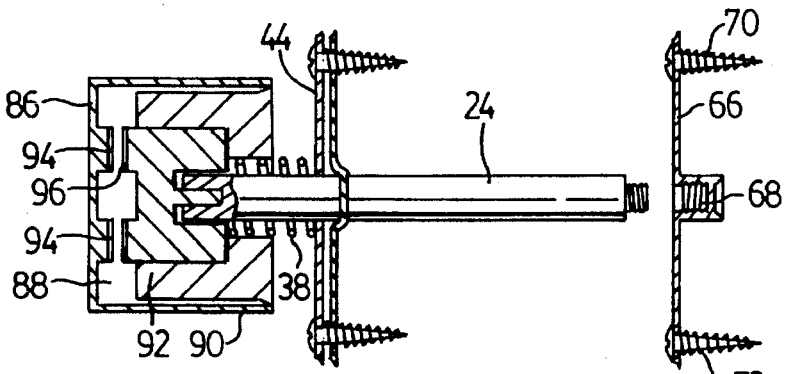
FIG. 3 is another side view, partly in cross-section, of another embodiment of the locking mechanism of the invention.

Another form of anchor device is that shown in FIG. 3. This is a plate-type anchor 66 with an extended, central, internally threaded aperture at 68. The anchor 68 has two screw holes formed at opposite ends thereof to permit it to be mounted by means of screws 70 to the vertical frame member or stile of the sliding glass panel unit.

Also shown in FIGS. 2 and 4 is an optional, externally threaded sleeve member 72 which is mounted in a fixed manner in the whole in the support frame. For example, in the embodiment of FIG. 4, it is mounted adjacent the outside surface of the hollow frame member 74, also known as the meeting stile in a sliding window system. The function of the sleeve member 72 is to hold the fastener 24 in the proper, aligned position. The sleeve member 72 is particularly desirable for use with a hollow frame member since, without it, the fastener 24 when disconnected from the anchor could become misaligned with the hole that extends through frame member 74. The external thread 76 can also be of the broken type comprising a series of pointed projections (similar to that used on the anchor device 52). Sleeve member 72 also has a circumferentially extending end flange 80 for proper axial positioning in the hole of the frame.

The final feature of the mechanism 10 of FIG. 2 is a flat, rectangular gasket 82 made of rubber or rubberlike material and having a hole through which the fastener 24 extends. This gasket is positioned adjacent the mounting plate 44 on the side thereof facing towards the threaded forward end section. The gasket can be made of closed cell, synthetic foam material and its purpose is to prevent air leakage through the hole formed in the-frame member for fastener 24.

In one preferred embodiment, the gasket had a thickness of 1/16th inch and its width and length are slightly shorter than those of the plate 44 which covers same. The preferred form of hole in the gasket for the fastener 24 is made with two small cuts that are perpendicular to one another and that cross at the centre, this form of cut providing a snug fit around the fastener.

In the locking mechanism of FIG. 3, the construction is similar to that of FIG. 2 except for the construction of the anchor device as already explained and except for the construction of the knob 86. This knob is of the "push and turn" type which is a known type of knob or cover used in other products for safety reasons. An example of a product using a similar type of device is a safety cap for a pill container which is intended to prevent children from obtaining dangerous pills. The knob comprises a cylindrical exterior portion 88 which has a skirt 90. There is also an internal knob section 92 which is the section connected rigidly to the fastener 24. Both portions 88 and 92 are formed with a circular series of ridges or teeth at 94 and 96 respectively which can only be effectively engaged by pushing on the exterior portion 88. With this type of knob construction, a small child will generally not be able to unlock the mechanism so as to permit the sliding window or door to be opened.

It will be appreciated that with the locking mechanism 10 of the invention, it is possible to secure together two glazing units in a firm and secure manner so that they cannot be opened from the outside. Furthermore, simply by tightening the threaded fastener 24 into its anchor device, one is able to pull together the adjacent vertical frame members and thus close any air gap between these frame members. This helps to prevent draughts and avoids unnecessary heat loss in cold weather conditions.

In a preferred embodiment the threaded fastener 24 is provided with wide threads on its forward end section so as to permit a locking engagement with only one or two turns of the knob. Of course the anchor device 52 would be formed with matching wide threads.

Figure 6:
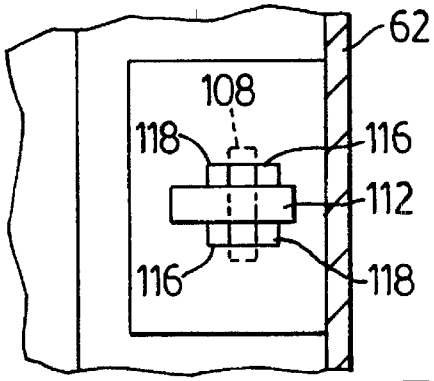
FIG. 6 is a detail cross-section taken along the line

An alternative embodiment of the invention is shown in FIGS. 5 and 6 of the drawings. This locking mechanism also includes an elongate fastener 100 having a forward end section at 102 and a rear end section 104. Mounted on the rear end section is a handle 106 which is used to rotate the fastener manually. This locking mechanism can also be provided with a coil spring 38 for the same purpose as in the first embodiment. Rigidly mounted on the forward end section is a securing device 108 which, in this version, is a straight end member that extends transversely to the longitudinal axis of the fastener 100. The forward end of the fastener is rigidly connected to the centre of this end member. The anchor device 110 in the version of FIGS. 5 and 6 is a rectangular plate member having a slot 112 formed therein. This slot is aligned with a further similar slot 114 in the frame member 62. These slots or apertures are sized and shaped to receive the end member 108 of the fastener. Once the end member and the fastener are pushed through this slot, the fastener is rotated 90 degrees by means of the handle in order to engage the securing device 108 with the anchor and thereby prevent longitudinal movement of the fastener.

In the preferred embodiment shown the anchor device is formed with two inclined ramps 116 located on opposite sides of the slot 112. Each ramp terminates in an upwardly extending stop 118 which prevents further rotation of the end member 108 as illustrated in FIG. 6. It will be understood that because of these ramps, full engagement of the securing device 108 with the anchor causes the glass panel unit in which the anchor is mounted to be pulled against the support frame 74. Thus with this version as well one is able to provide a limited amount of clamping action in order to reduce or eliminate any air gap between the adjacent frame members.

The preferred embodiment shown in FIGS. 7 and 8 is similar in many respects to that shown in FIGS. 2 and 4. However, this embodiment is equipped with a turning handle 106 instead of a knob. Also, the coil spring 38 is enclosed at one end by a cylindrical extension 120 that is an integral part of the mounting member 122. This cylindrical extension is open at the handle end and closed at the sash end. The extension improves the appearance of the locking mechanism and helps keep dirt away from the working components.

Also in the embodiment of FIGS. 7 and 8 the anchor device 52 and the sleeve members 72 are shown without any end flange 64 or 80. This is the preferred construction as it permits the anchor device and sleeve member to be threaded into each sash section so that its end is flush with the side surface. This in turn permits the fastener to pull the two sash sections together so that there is no air gap between them.

In the preferred embodiment of FIG. 9, a locking mechanism 130 includes a fastener 132 with a threaded shaft 154. This shaft 154 has a threaded forward end section 134. The fastener includes a plastics handle member 136 which forms a cylindrical, annular chamber 138. This chamber receives one end of a coil spring 140. This mechanism has a mounting plate 142 for rotatably mounting the fastener in a support frame (not shown). The fastener extends through a central hole 144 in the support plate and also through a hole in the support frame. The plate 142 is connected to the support frame by means of standard screws (not shown). Extending towards the handle is a plastics cylindrical enclosure 148 which can be an integral extension of the mounting plate. In the preferred embodiment, the enclosure 148 is formed with two external grooves 146 that extend in the axial direction. These grooves are open-ended at the end close to the plate 142 and are closed at the opposite end by means of a small stop 149 with a sloping top. The two grooves are interconnected by a circumferentially extending groove indicated at 150.

The construction of the handle member 136 is illustrated in some detail in FIGS. 12 and 13. The handle member has a straight downward extension 200. In this extension there is formed a central slot 202 which extends through the extension from front to back and which is sized to snugly receive a locking lever 204 which is a preferred, optional feature of the handle. Located on opposite sides of the slot are two small, circular recesses 206 and preferably, beside each recess is a short sloping surface 208 that extends to the rear surface of the extension. The recesses 206 are sized to receive two short pivot pins 210 formed on the locking lever. Preferably these pivot pins also have sloping tops so that the pins will slide along the slots 208 and snap into the recesses 206.

Also shown in FIG. 13 are two flexible support arms or levers 212 which are positioned on opposite sides of the annular chamber 138 and adjacent the rear surface of the handle. These levers are spaced outwardly a short distance from the adjacent wall 214 so that the levers are able to flex outwardly a short distance. Arranged on each lever is a short locking pin 216 with a sloping end surface. It will be understood that the pins 216 can be forced over the stops 149 because of the interengaging sloping surfaces and the flexible to levers. Once the pins 216 pass the stops, the pins will engage into the grooves 146, thereby securing the handle to the enclosure 148 while at the same time permitting the handle to slide axially on this enclosure. Furthermore, when the handle is pressed fully against the plate 142, it can be rotated because the two pins 216 will be located in the annular groove 150.

Turning now to the construction of the locking lever 204 which is pivotably mounted in the handle, the lever is oriented in the manner shown in FIG. 9 relative to the handle member. At the bottom of the lever is a flexible arm 220 which acts as a spring for the lever which is made of a flexible plastic material such as a suitable nylon. This arm presses against the bottom of the aforementioned slot 202 in the handle. Projecting outwardly from the top of the lever is a locking pin or protuberence 222. This pin is designed to engage the cylindrical enclosure 148 in a manner described below. When the front surface 224 of the lever is pushed, the lever will pivot about the pins 210, disengage the pin 222 from the enclosure 148 and permit rotation of the handle member. A locking lever is provided to prevent the handle from turning either way when it is fully engaged with the enclosure 148.

As illustrated in FIG. 14, the enclosure 148 has two cutouts 228 and 230 formed in its exterior and spaced around the circumference about 90 degrees from one another. The smaller cut-out 228 is next to one of the grooves 146 and it will be understood that both cut-outs 228 and 230 are actually spaced on the enclosure so as to be aligned with the locking pin 222. Because the locking pin is biased to move to the engaged position, when the handle is turned one-half rotation, the pin will slide into cut-out 228 and engage the opposite sidewall of the adjacent groove 146, thereby preventing further rotation of the handle. If one then presses on the front of the lever 204 to disengage the locking pin, the handle can be turned another quarter turn until the locking lever engages the flat end of cut-out 230.

In the embodiment of FIG. 9, a shaft adjustment screw 156 is fitted into an axial, threaded passageway 158 formed in the shaft 154. The passageway 158 extends from a rear end of the shaft as shown. The screw 156 enables the effective length of the fastener to be adjusted to suit the particular window frames or door frames on which the locking mechanism is to be used. The adjustment screw has a head 160 at one end thereof and the width of this head is greater than the inside diameter or width of an internal shoulder 162 formed at one end of a non-circular passageway 164. In the illustrated embodiment, the passageway 164 is hexagonal. The shaft 154 also has a non-circular cross-section along a rear end section indicated at 166 and its cross-section corresponds to that of the passageway. Thus, in the assembled mechanism, this rear end section 166 is inserted into the non-circular passageway 164 and is prevented from rotating therein by the cross-sectional shape. However, the shaft 154 is free to be retracted into or extended out from the passageway 164 by means of the adjustment bolt 156. The passageway 164 is formed by a generally tubular internal wall 170 that is an integral part of the handle. At the outer end of the passageway 164 is a short, internally threaded section 172 which is provided in order to receive a threaded cap or cover 174. The outer face of the cap 174 is formed with a screwdriver slot 175. By removing the cap, one can gain access to the passageway in order to adjust the position of the bolt 156.

In the illustrated preferred embodiment of FIG. 9, the threads formed at 134 on the shaft are broken by a longitudinally extending V-groove 178. The purpose of this V-groove is to enable quick engagement between this preferred fastener and a specially designed anchor device 180 illustrated in FIGS. 10 and 11. This anchor device has an aperture 182 and arranged therein in a row are a series of partial threads or bumps 186 that are formed by dimples 187 formed in the cylindrical exterior of the anchor. The bumps 186 are aligned in the axial direction. It will thus be appreciated that the threaded end of the fastener can be pushed substantially into the aperture 182 quickly by aligning the V-groove with the bumps 186. Then a small amount of rotation of the handle 136 will cause full engagement between the threads of the fastener and the bumps or partial threads in the anchor device.

The device 180 is provided with a radially outwardly extending flange 190 at one end for positioning the device properly in the frame of the sliding panel unit.

Also shown in FIG. 9 is a sleeve member 194 which forms an aperture 195 through which the fastener extends. The preferred illustrated sleeve member includes a radially outwardly extending circumferential flange 196 at one end. The sleeve member is equipped with external securing means in the small sharp-angled ridges 198 which point towards the flange 196 and extend circumferentially around the sleeve member. These help to secure and hold the sleeve member in the side of the window or door frame. In a particularly preferred method of construction, the sleeve member or bracket 194 and the anchor device 180 are thermally welded to their respective sashes when the latter are constructed from vinyl or PVC. In this process, the sleeve member 194 or the anchor device, both of which are made of a suitable metal, are heated to a temperature in the range of 370 to 400 degrees C. prior to attachment to the window frame. Then, when the hot metal part is engaged with the plastic frame it causes the plastic to melt around the metal part securing the part in place. The exact temperature to which the metal part is heated will dependent to some extent on the thickness of the vinyl or PVC being used and the number of walls in the door or window frame.

Instead of having a short sleeve member to support the shaft of the locking mechanism, it is possible to have an elongate sleeve member that extends completely through the window or door frame. In this elongate version, one end of the sleeve member may be externally threaded and it may thread into an internally threaded connecting member that takes the place of the mounting plate used in the illustrated embodiments. This connecting member may be provided with a circumferential wall defining an annular or substantially annular chamber to receive one end of the coil spring. This wall is connected by an end plate to an internally threaded sleeve section that projects in the same direction as the circumferential wall towards the handle. It is this sleeve section which is connected to the elongated sleeve member. The sleeve member is prevented from rotating in the window frame by means of teeth formed on a radially outwardly extending flange (similar to the teeth used on sleeve member 194 in FIG. 9). The elongate fastener device can be connected to the handle by means of a washer and nut if the handle end of the shaft is threaded.

It will be obvious to those skilled in the construction of fastening devices for windows and doors that various modifications and changes could be made to the described locking mechanism without departing from the spirit and scope of this invention. Accordingly, all such modifications and changes as fall within the scope of the appended claims are intended to be part of this invention.

I claim:

1. A locking mechanism for securing a glass panel unit comprising:

an elongate fastener having a forward end section with a securing device provided thereon and a rear end section, said fastener including means for rotating same about its central axis mounted on said rear end section and means for adjusting the length of said fastener from said rotating means to the forward end thereof;

means for rotatably mounting said fastener in a support frame so that said fastener extends through a hole in said support frame; and an anchor device with an aperture adapted for mounting fixedly in said glass panel unit, said aperture being capable of receiving said forward end section of said fastener whereby said glass panel unit is secured against movement when said forward end section is in said aperture and said securing device is engaged with said anchor device by rotation of said fastener.

2. A locking mechanism according to claim 1 including a coil spring arranged on said fastener between said mounting means and said rotating means, one end of said spring resting against said mounting means and an opposite end thereof resting against said rotating means, said spring acting to bias said fastener away from said anchor device when the latter is mounted in said glass panel unit.

3. A locking mechanism according to claim 1 wherein said mounting means is a mounting plate having a hole through which said fastener extends and screws for connecting said plate to said support frame.

4. A locking mechanism according to claim 2 wherein said rotating means is a knob that permits manual rotation of said fastener.

5. A locking mechanism according to claim 2 wherein said anchor device is an internally threaded sleeve member with a radially outwardly extending circumferential flange at one end, said anchor device including external securing means for fixedly holding said anchor device in said sliding glass panel unit.

6. A locking mechanism according to claim 2 wherein said anchor device is a plate-type anchor with screw holes formed therein and said anchor in use is mounted to said glass panel unit by means of screws.

7. A locking mechanism according to claim 1 including a sleeve member adapted for mounting in a fixed manner in said hole in said support frame and for holding said fastener which extends through said sleeve member, said sleeve member including external securing means for fixedly holding said sleeve member in said support frame.

8. A system of sliding glazing units for a building or other large structure comprising:

first and second glazing units, at least one of which is adapted for sliding movement relative to the other;

an elongate fastener which has a forward end section with a securing device provided thereon, said fastener including means for rotating the fastener about its central axis located at a rear end thereof and means for adjusting the length of said fastener from said rotating means to the forward end thereof;

means rotatably mounting said fastener in said first glazing unit so that said fastener extends through a hole in a frame that forms an edge portion of said first glazing unit; and an anchor device with an aperture mounted or formed in said second glazing unit, said aperture being capable of receiving said forward end section of said fastener and said securing device, wherein both of said glazing units are prevented from sliding movement when the forward end section of said fastener is received in said aperture and said securing device is engaged with said anchor device by rotation of said fastener.

9. A system of sliding glazing units according to claim 8 including a coil spring arranged on said fastener between said mounting means and said rotating means, one end of said spring resting against said mounting means and an opposite end thereof resting against said rotating means, said spring acting to bias said fastener away from said anchor device.

10. A system of sliding glazing units according to claim 9 wherein said mounting means is a mounting plate having a hole through which said fastener extends and screws which connect said plate to said frame of said first glazing unit.

11. A system of sliding glazing units according to claim 9 wherein said rotating means is a knob that permits manual rotation of said fastener.

12. A system of sliding glazing units according to claim 9 wherein said glazing units are sliding glass window units each of which has a rectangular frame extending about its periphery and a glass panel mounted in said frame.

13. A locking mechanism for securing a sliding glazing unit comprising:

an elongate fastener comprising a shaft having a forward end section with a securing device provided thereon, a shaft adjustment bolt, and a knob or handle at a rear end of said shaft for rotating the fastener about its central axis, said shaft being formed with an axial threaded passageway in a rear end thereof and with a non-circular cross-section along a rear section thereof, said adjustment bolt being threaded into said passageway, said knob or handle having a corresponding non-circular passageway formed therein for receiving said rear end section of said shaft whereby rotation of said shaft in said knob or handle is prevented;

a mounting plate for rotatably mounting said fastener in a support frame so that said fastener extends through holes in said plate and said support frame;

fastener means for connecting said plate to a side of said support frame; and an anchor device with an aperture adapted for mounting in a frame of said sliding glass panel unit, said aperture being capable of receiving said forward end section of said fastener and said securing device whereby said glazing unit is prevented from sliding movement when the forward end section is in said aperture and said securing device is engaged with said anchor device by rotation of said fastener.

14. A locking mechanism according to claim 13 including a coil spring arranged on said fastener between said mounting plate and said knob or handle, an end of said spring resting against said mounting plate and an opposite end thereof resting against said knob or handle, said spring acting to bias said fastener away from said anchor device when the latter is mounted in said glass panel unit.

15. A locking mechanism according to claim 14 including a sleeve member adapted for mounting in a fixed manner in said hole in said support frame and for holding said fastener which extends through said sleeve member, said sleeve member having a radially outwardly extending flange at one end and gripping teeth formed on said flange for fixedly holding said sleeve member in said support frame.

16. A locking mechanism according to claim 14 including a gasket made of rubber or rubberlike material and having a hole through which said fastener extends, said gasket being positioned adjacent said mounting plate on a side thereof facing towards said forward end section of said fastener.

17. A locking mechanism according to claim 14 wherein said securing device on said forward end section comprises threads formed on the shaft and said threads are broken by a longitudinally extending V-groove and said anchor device is formed with only partial threads that extend through an arc of less than 90 degrees and are aligned in the axial direction.

18. A locking mechanism according to claim 13 wherein said shaft adjustment bolt has a head at one end thereof and the width of said head is greater than at least the minimum width of the non-circular passageway in said knob or handle so that said head cannot pass through said non-circular passageway and is held in said knob or handle.

19. A glass panel apparatus comprising:

a glass panel unit having a sash with one side section extending perpendicular to the direction of sliding movement of the unit, said one side section having a hole extending transversely thereof;

an elongate fastener having forward and rear ends, said fastener extending through said hole in the sash;

means for actuating said elongate fastener connected to said rear end, said actuating means comprising a handle member;

a coil spring arranged on said fastener and having two opposite ends, one end of said spring resting against said actuating means;

mounting means for rotatably mounting said fastener to said one side section, said mounting means including a mounting plate, said fastener extending through a hole in said plate, the other end of said spring resting against said mounting means;

a locking lever pivotably mounted in said handle member, said lever being pivotable to a position of engagement with said mounting means whereby rotational movement of said handle member and said fastener is prevented and being pivotable to a position of disengagement with said mounting means whereby said handle member and fastener can be rotated as desired; and an anchor device adapted to engage a forward end section of the fastener and mountable in a supporting frame member, said spring acting to bias said fastener away from said anchor device when the latter is mounted in said supporting frame member, wherein when said fastener is engaged in said anchor device, relative sliding movement between said glass panel unit and said supporting frame member is prevented.

20. An apparatus according to claim 19 including bolt means for adjusting the length of said fastener, said bolt means being threadedly received in a rear end section of said fastener.

21. A locking mechanism according to claim 1 wherein said adjusting means is a bolt threaded into an axial passageway in said rear end section of said fastener, said rotating means is a handle or knob having a passageway for non-rotatably receiving said rear end section of said fastener, and said bolt has a head with a width greater than the width of said passageway.

22. A locking mechanism according to claim 1 wherein said rotating means is a handle member with a locking lever pivotably mounted therein, said lever being pivotable to a position of engagement with said mounting means whereby rotational movement of said handle member is prevented and being pivotable to a position of disengagement with said mounting means whereby said handle member can be rotated as desired.

23. A locking mechanism according to claim 14 wherein said fastener includes a handle with a locking lever pivotably mounted therein and means for biasing said lever to a position of engagement with said mounting plate whereby rotational movement of said handle is prevented and being manually pivotable to a position of disengagement with said mounting plate whereby the handle can be rotated as desired.

* * * * *